US006712147B2

(12) United States Patent
Dallas

(10) Patent No.: US 6,712,147 B2
(45) Date of Patent: Mar. 30, 2004

(54) SPOOL FOR PRESSURE CONTAINMENT USED IN RIGLESS WELL COMPLETION, RE-COMPLETION, SERVICING OR WORKOVER

(76) Inventor: L. Murray Dallas, 790 River Oaks Dr., Fairview, TX (US) 75069

( * ) Notice: Subject to any disclaimer, the term of this patent is extended or adjusted under 35 U.S.C. 154(b) by 0 days.

(21) Appl. No.: 09/998,953

(22) Filed: Nov. 15, 2001

(65) Prior Publication Data

US 2003/0089502 A1 May 15, 2003

(51) Int. Cl.[7] ..... E21B 33/038; E21B 33/06

(52) U.S. Cl. ..... 166/379; 166/85.4; 166/94.1; 166/382

(58) Field of Search ..... 166/379, 382, 166/387, 85.1, 85.4, 86.1, 93.1, 94.1, 97.1, 75.13, 308

(56) References Cited

U.S. PATENT DOCUMENTS

| | | | | | |
|---|---|---|---|---|---|
| 3,738,426 | A | * | 6/1973 | Drouin | 166/382 |
| 4,076,079 | A | * | 2/1978 | Herricks et al. | 166/308 |
| 4,125,164 | A | * | 11/1978 | Terry | 166/377 |
| 4,241,786 | A | | 12/1980 | Bullen | 166/77 |
| 4,476,936 | A | * | 10/1984 | Boyadjieff et al. | 166/383 |
| 4,632,183 | A | * | 12/1986 | McLeod | 166/77.4 |
| 4,867,243 | A | | 9/1989 | Garner et al. | 66/379 |
| 5,540,282 | A | * | 7/1996 | Dallas | 166/379 |
| 5,785,121 | A | * | 7/1998 | Dallas | 166/90.1 |
| 5,819,851 | A | * | 10/1998 | Dallas | 166/308 |
| 5,988,274 | A | | 11/1999 | Funk | 166/77.4 |
| 6,009,941 | A | | 1/2000 | Haynes | 166/72 |
| 6,145,596 | A | | 11/2000 | Dallas | 166/379 |
| 6,179,053 | B1 | * | 1/2001 | Dallas | 166/77.51 |
| 6,209,633 | B1 | | 4/2001 | Haynes | 166/72 |
| 6,220,363 | B1 | | 4/2001 | Dallas | 166/382 |
| 6,234,253 | B1 | * | 5/2001 | Dallas | 166/377 |
| 6,289,993 | B1 | * | 9/2001 | Dallas | 166/386 |
| 6,364,024 | B1 | * | 4/2002 | Dallas | 166/379 |
| 6,470,965 | B1 | * | 10/2002 | Winzer | 166/77.4 |

OTHER PUBLICATIONS

Patent application Ser. 09/537,629 entitled "Blowout Preventer Protector and Method of Using Same," filed Mar. 29, 2000.

Patent application Ser. 09/791,980 entitled "Method and Apparatus for Inserting a Tubing Hanger Into a Live Well," filed Feb. 23, 2001.

* cited by examiner

*Primary Examiner*—David Bagnell
*Assistant Examiner*—Jennifer H Gay
(74) *Attorney, Agent, or Firm*—Nelson Mullins Riley & Scarborough, LLP

(57) ABSTRACT

An apparatus for rigless subterranean well completion, re-completion, servicing or workover includes at least two substantially vertically oriented double acting prime movers incorporated into a spool for pressure containment, which is mounted to the top of a wellhead. The spool further includes a Bowen union mounted to a top thereof for sealingly connecting an annular adapter, which provides a seal between the well bore and a tubular that is inserted under the well fluid pressure into the well by the prime movers. The spool may further include a mechanism for securing a hydraulic crane that can be temporarily mounted to the top of the spool to hoist equipment and tools above the wellhead when the prime movers are used to support heavy workloads induced by well fluid pressure or the weight of a tubing string. The apparatus can be used in various operations for well completion, re-completion, servicing or workover without the necessity of using a servicing rig. Consequently, the cost of those operations is significantly reduced.

21 Claims, 12 Drawing Sheets

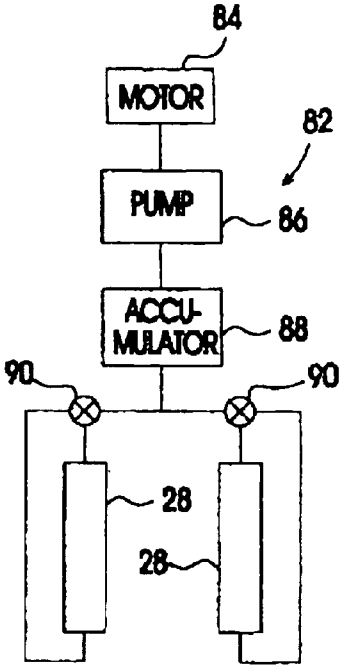
FIG. 5
FIG. 6
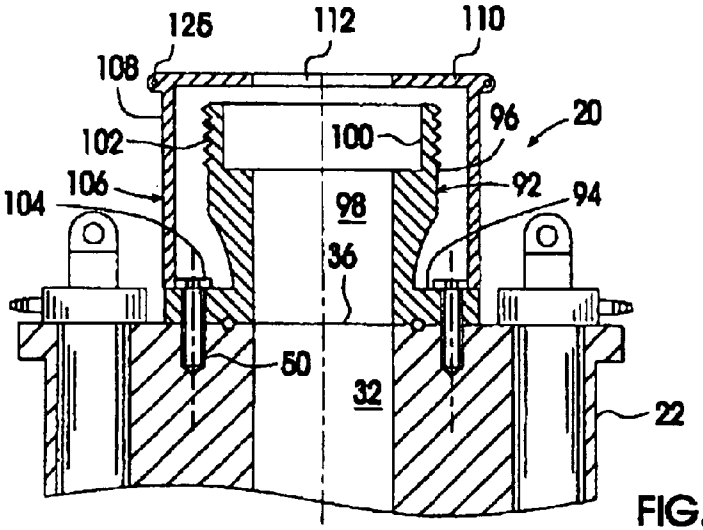
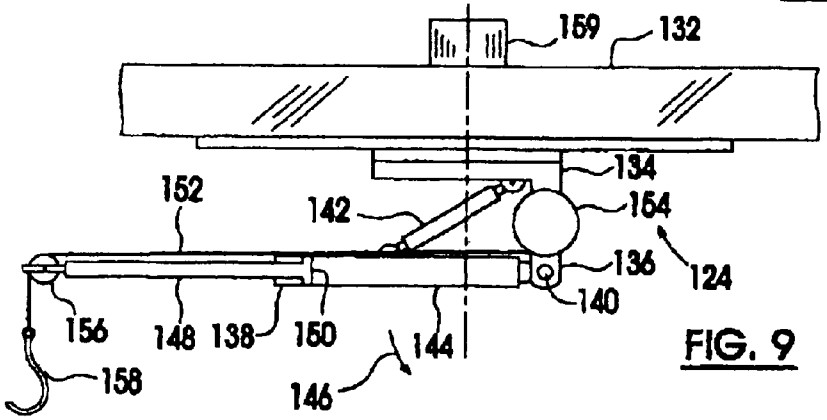
FIG. 9

SPOOL FOR PRESSURE CONTAINMENT USED IN RIGLESS WELL COMPLETION, RE-COMPLETION, SERVICING OR WORKOVER

FIELD OF THE INVENTION

The present invention relates in general to methods and apparatus for well completion, re-completion, servicing or workover, and in particular to methods and apparatus for well completion, re-completion, servicing or workover without the assistance of a service rig.

BACKGROUND OF THE INVENTION

Subterranean wells that are drilled to produce oil or gas must be prepared for production and reworked or serviced from time to time. Wells may require reworking or service for a number of reasons.

The preparation of subterranean wells for the production of oil and gas is a complex process which requires specialized equipment that is expensive to purchase, operate and maintain. Because many wells are now drilled in marginal bearing formations, the wells may require fracturing or some other form of stimulation treatment before production becomes economical. The preparation of a new well for production is called well completion. Well completion generally involves wellhead installation, casing perforation, production tubing installation, etc. If the well is in a marginal production zone, the well may require stimulation after casing perforation. Traditionally, after a well was stimulated, it was "killed" by pumping in overbearing fluids such as drilling mud to permit a wellhead to be put on the casing. This practice is losing favor, however, as it has been observed that killing a well may reverse much of the benefit gained by the stimulation process.

It is also common practice now to re-complete hydrocarbon wells to extend production. Hydrocarbon wells are re-completed using drilling and/or production stimulation techniques well known in the art. Re-completion generally requires the same tools and equipment required for well completion.

Well workover generally entails well treatments to stimulate hydrocarbon production in wells in which production has dropped below an economically viable level. Such treatments may include high pressure fracturing and/or acidizing. During well stimulation it is common knowledge that it is preferable to introduce stimulation fluids into the well at the highest possible transfer rate. Consequently, it is now common practice to remove the wellhead and pump stimulation fluids through the blowout preventers and into the casing. In order to protect the blowout preventers from washout, blowout preventer protectors have been invented, as described, for example, in Applicant's U.S. Pat. No. 5,819,851 which issued on Oct. 13, 1998, the specification of which is incorporated herein by reference.

Generally, when a well completion, re-completion or workover is required a service rig is brought in and set up to remove the wellhead components, shift or remove production tubing, etc. Such rigs have a derrick or mast that supports pulleys or block and tackle arrangements operable to pull the wellhead from the well, shift the production tubing string or remove it from the well bore, run a production tubing string or other tools into the well bore, unseat and reseat the packers and/or anchors in the well bore, etc.

Although rigs are very useful and adapted to perform any job associated with manipulating well components during a well completion, re-completion, or workover, they are complex assemblies of equipment that are expensive to construct and maintain. Besides, they generally require a crew of four, so they are expensive to operate. Rigs are also usually only intermittently during a well completion, re-completion, servicing or workover operation. Consequently, there is normally considerable idle time on such rigs. This is uneconomical and contributes to the cost of production.

Wells may require service to replace worn or faulty valves, replace or renew seals, to remove a flange from the wellhead, or insert a new flange into the wellhead. Many of these operations are relatively simple and do not require much time. It is therefore uneconomical to bring in and set up a service rig to perform the well service operation.

There is therefore a need for a method and an apparatus that is adapted to provide the functionality required for most well completion, re-completion, servicing and workover jobs, without the requirement of a service rig.

SUMMARY OF THE INVENTION

It is therefore an object of the invention to provide an apparatus that is adapted to perform a variety of operations associated with subterranean well completion, re-completion, servicing or workover without the use of a service rig.

It is another object of the invention to provide a wellhead spool for pressure containment that may be used for rigless completion, re-completion, servicing or workover a subterranean well.

It is a further object of the invention to provide methods for rigless completion, re-completion, servicing or workover of a subterranean well.

The invention therefore provides an apparatus that includes a spool for pressure containment that can be mounted to a tubing head spool to permit a well to be completed, re-completed, serviced or worked over without the use of a service rig. The spool supports prime movers, such as hydraulic cylinders, ball jacks or screw jacks, used to insert tubulars, tools or wellhead components into or remove them from the well bore. The spool may be a blowout preventer (BOP) or a high pressure valve. The prime movers may be supported in bores that extend through a body of the spool, or by brackets welded to sidewalls of the spool.

The apparatus in accordance with the invention permits most well completion, re-completion, service and workover operations to be performed without the use of a service rig. Considerable savings are therefore realized.

BRIEF DESCRIPTION OF THE DRAWINGS

Having thus generally described the nature of the present invention, reference will now be made to the accompanying drawings, showing by way of illustration the preferred embodiments thereof, in which:

FIGS. 4*a* through 4*d* illustrate alternative arrangements of securing prime movers to the spool shown in FIG. 1, or the spool shown in FIG. 2, in which FIGS. 4*a* and 4*b* are respectively partial side elevational and partial top plan views of a prime mover with its securing mechanism incorporated into spools, and FIGS. 4*c* and 4*d* are, respectively, a top plan and a cross-sectional view of a clamp used for securing the prime mover;

FIG. 5 is a block diagram illustrating hydraulic circuits for supplying pressurized hydraulic fluid to hydraulic cylinders, when the hydraulic cylinders are used as prime movers;

FIG. 6 is a partial cross-sectional view of FIG. 1 or FIG. 2, according to a further embodiment of the present invention, showing a Bowen union mounted to a top of the spools and protected by a protective bonnet;

FIG. 9 is a side view of the hydraulic crane shown in FIG. 8;

DETAILED DESCRIPTION OF THE PREFERRED EMBODIMENTS

The invention provides an apparatus and methods for completing, re-completing or performing a workover on a well bore without using a service rig. The apparatus and methods can be used in completing any well in which coil tubing is to be used for production. The method and apparatus can also be used for re-working substantially any well in which tubing is already installed. The apparatus is also useful during well re-completion or servicing procedures, and permits tool insertion and other operations to be performed without the expense of a service rig.

Figure 1:
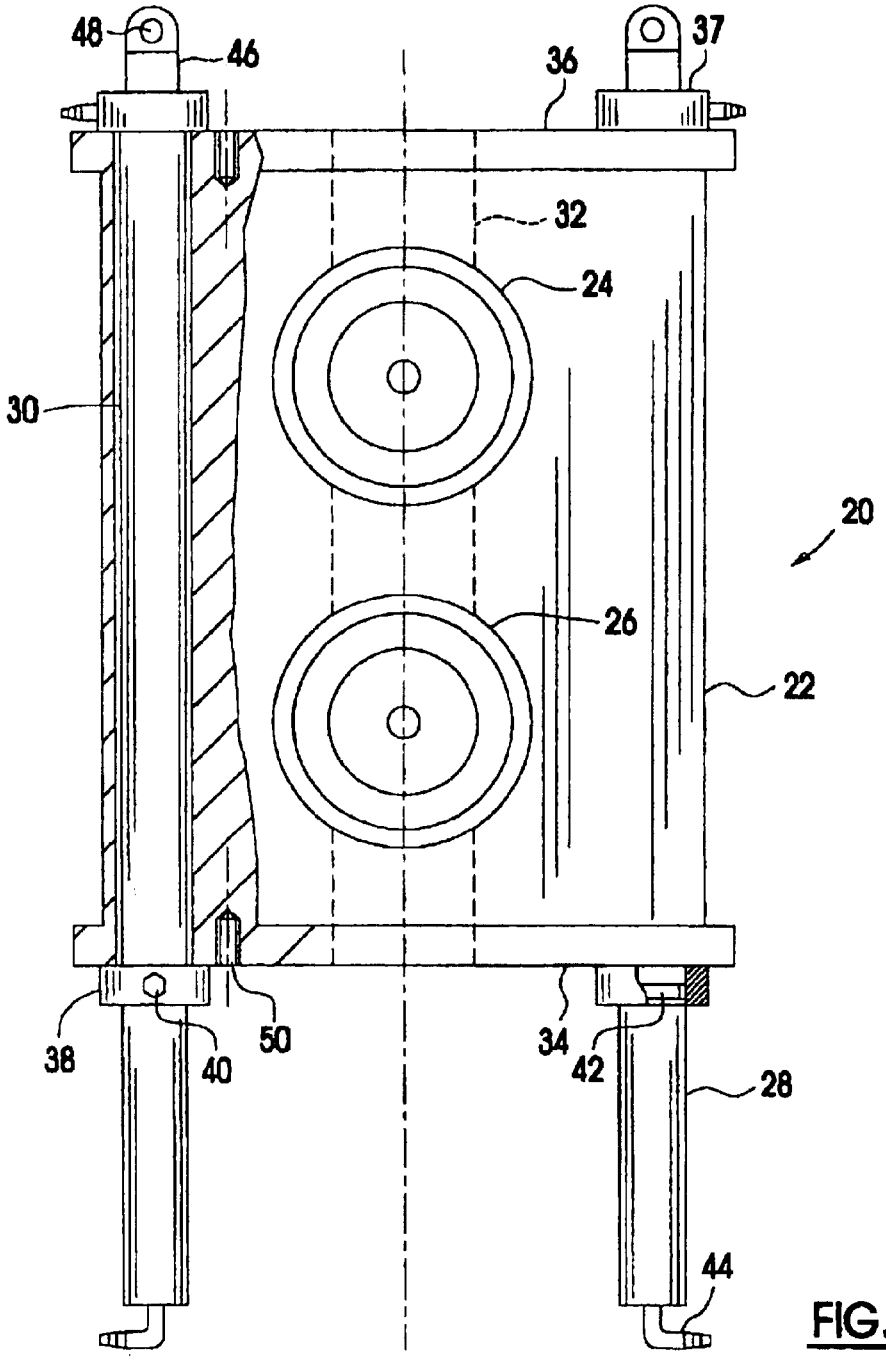
FIG. 1 is a side elevational view, partially in cross-section, of a spool for pressure containment in accordance with an embodiment of the invention.

FIG. 1 shows an apparatus, partially in a cross-sectional view in accordance with one embodiment of the present invention, generally indicated by reference numeral 20. The apparatus 20 includes a spool for pressure containment 22 having at least one flow control mechanism 24, 26. In this example, the spool for pressure containment is a blowout preventer (BOP) 22 having opposed tubing rams 24 used to close an annulus of the well bore (not shown) around a production tubing (not shown) of a known diameter, and a set of opposed blind rams 26, which are used to completely seal the well bore. The construction of the tubing rams and blind rams of a BOP is well known in the art and will not be further described.

A pair of bi-directional prime movers 28 are secured to the BOP 22 at opposed sides thereof. The prime movers 28 may be screw jacks, ball jacks or, as illustrated in FIG. 1, hydraulic cylinders. The prime movers 28 are substantially vertically oriented and are received or secured by mechanisms integrated with the BOP 22. In this embodiment of the invention, the BOP 22 includes a pair of bores 30 that are oriented in a substantially parallel relationship to a central bore 32 of the BOP 22. The prime movers 28 are received in the respective bores 30 and extend therethrough. In order to provide a sufficient length of stroke, each prime mover 28 is longer than the bore 30 so that a lower end of the prime mover 28 projects downwardly from a bottom 34 of the BOP 22 when the top end of the prime mover 28 is secured to a top 36 of the BOP 22. As will be understood by persons skilled in the art, the prime movers 28 can also be arranged to extend above, rather than below, the BOP 22.

A cylinder cap 37 having a larger diameter than the prime mover 28, serves as a stop to restrain downward movement of the prime mover 28 relative to the BOP 22. A lock ring 38 secured to the prime mover 28 by set screws 40 restrains the prime mover 28 from upward movement relative to the BOP 22. The set screws 40 engage an annular groove 42 formed around the prime mover 28 just below the bottom 34 of the BOP 22. Hydraulic connectors 44 are provided at opposite ends of the prime mover 28 to permit hydraulic fluid to be injected into or withdrawn from either end of the prime mover 28, in order to achieve a double acting functionality. The piston ram 46 of each prime mover 28 is provided with a bore 48 at its top end for connecting a workload or an extension rod, as will be further described below.

The BOP 22 is provided with a plurality of threaded bores 50 in the bottom flange 34 and top flange 36 to permit the BOP 22 to be secured to other spools of a wellhead.

Figure 2:
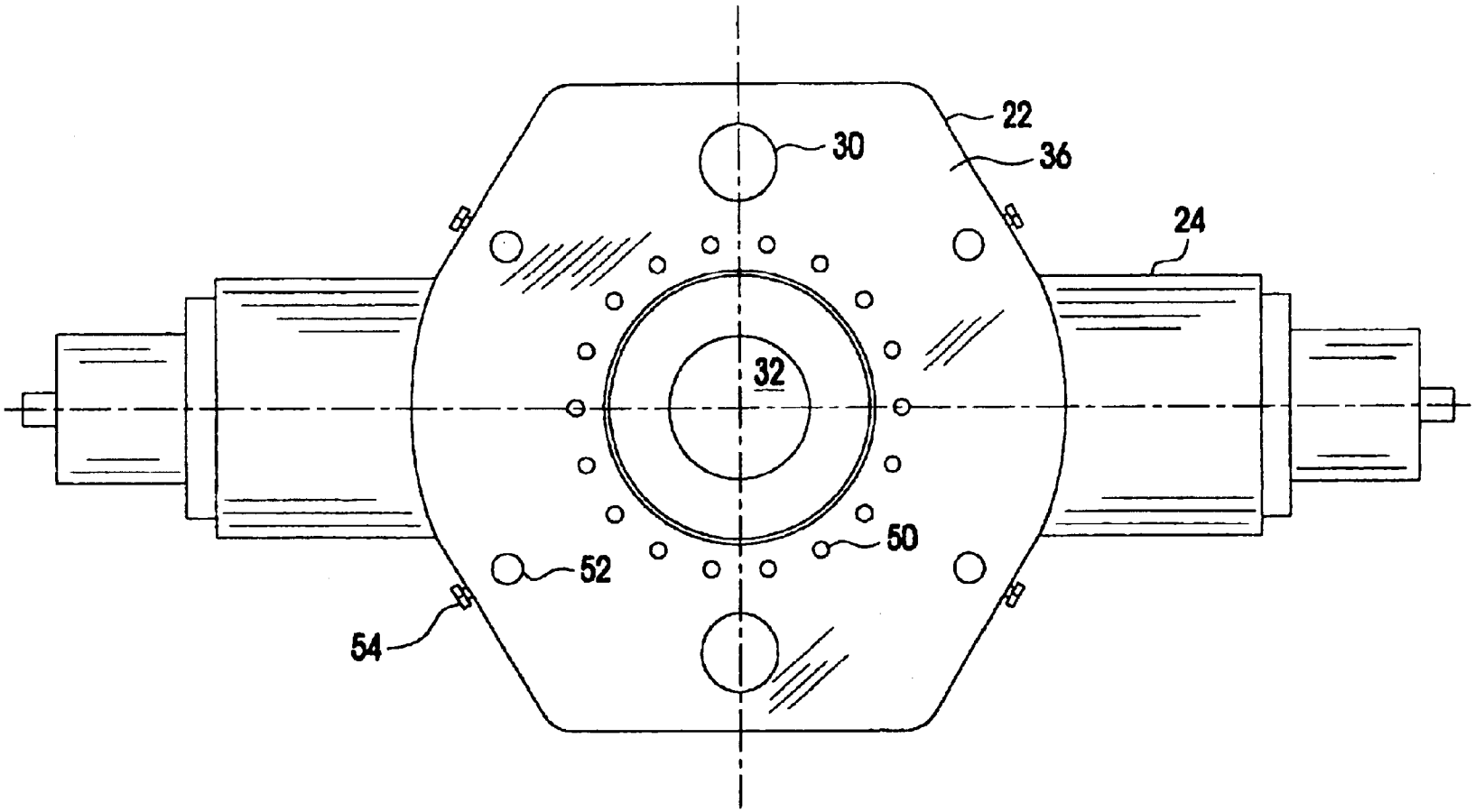
FIG. 2 is a top plan view of the spool shown in FIG. 1.

FIG. 2 shows a top plan view of the BOP 22 shown in FIG. 1, without the prime movers 28. Four cylindrical bores 52 are machined into the top 36 of the BOP 22, adjacent to a periphery thereof. The bores 52 receive and support support beams for a hydraulic crane, which will be further described with reference to FIGS. 8 and 9. Set screws 54 are used to lock the support beams in the bores 52.

Figure 3:
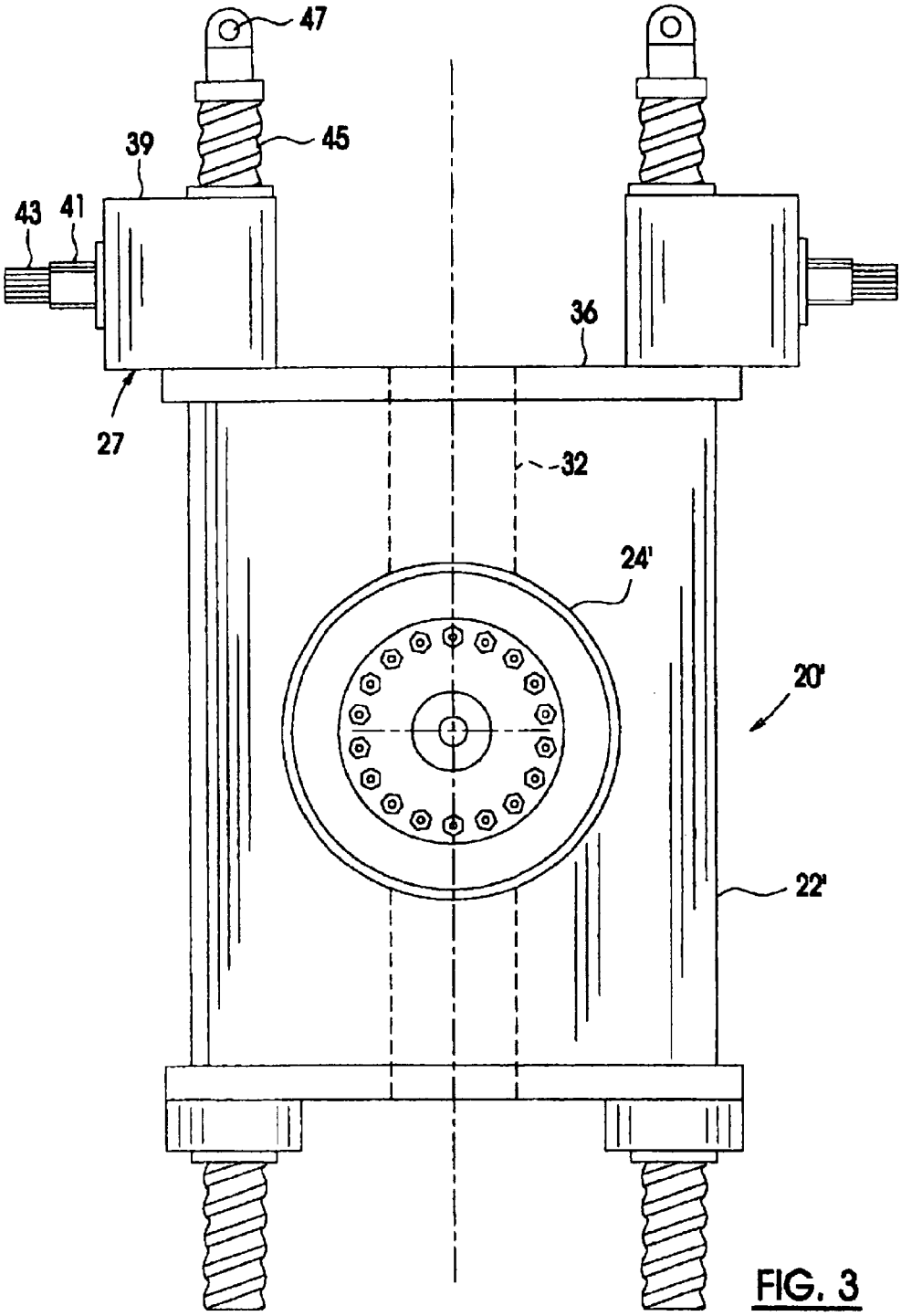
FIG. 3 is a side elevational view, partially in cross-section of a spool for pressure containment in accordance with another embodiment of the invention.

FIG. 3 shows an apparatus 20' in accordance with another embodiment of the invention. The spool for pressure containment 20' is a high pressure valve 22' having at least one flow control mechanism 24', which is a high pressure valve used for containment of pressurized fluid within a well bore, and is well known in the art. As described above with reference to FIG. 1, high pressure valve 22' includes a pair of parallel bores. The bores in this example support prime movers that are screw or ball jacks 27, which include a power transfer case 39 having a drive shaft 41 with a connector end 43 adapted to be connected to a hydraulic motor (not shown), or some other drive power source. The power transfer case translates rotational movement of the drive shaft 41 into vertical movement of a threaded shaft 45, in a manner well known in the art. The top end of the threaded shaft 45 includes a bore 47 for connection of an extension or other tool, as will be explained below in more detail. Other structural features of the apparatus 20' are similar to those described with reference to the apparatus 20 shown in FIG. 1. The top 36 of the high pressure valve 22' has a layout similar to that of the BOP 22 described above with reference to FIG. 2.

Figure 4E:
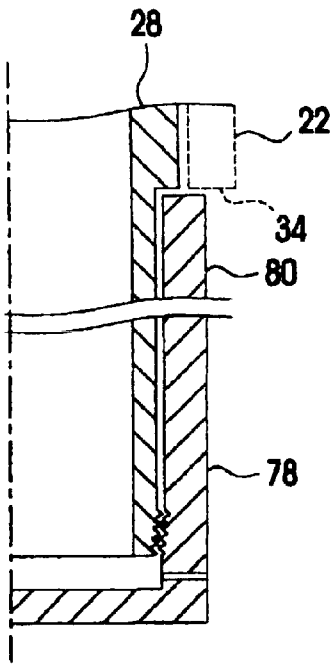
FIG. 4*e* is a partial cross-sectional view of the prime mover, showing an alternative configuration thereof.
Figure 4B:
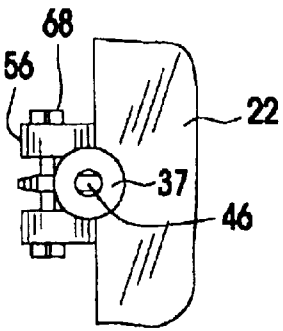
Figure 4C:
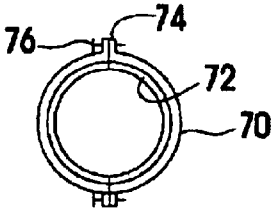
Figure 4D:
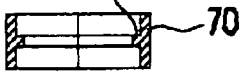
Figure 4A:
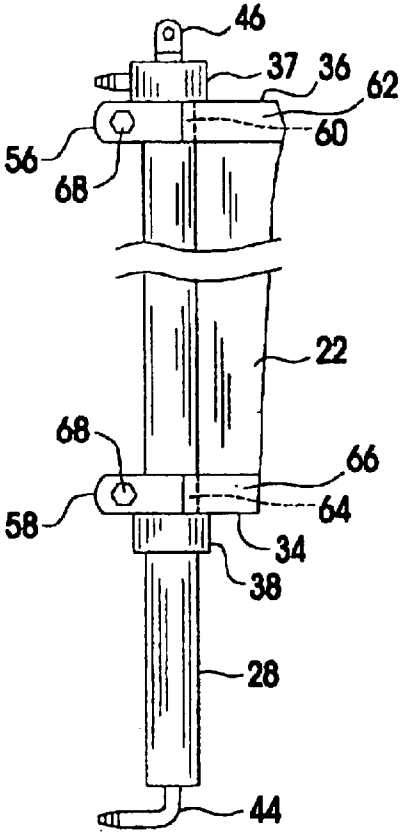

FIGS. 4*a* and 4*b* show an alternative configuration for securing the prime movers' hydraulic cylinders 28 or jacks 27 to the BOP 22. Instead of the bores 30 through the BOP 22 shown in FIG. 1, the BOP 22, partially shown in FIGS. 4*a* and 4*b*, includes a pair of brackets 56 at opposite sides of the top 36 thereof and a pair of brackets 58 at the opposite sides of the bottom 34. The pair of brackets 56 are spaced apart slightly more than an external diameter of the prime movers 27, 28 and a groove 60 is formed in a top flange 62 of the BOP 22. Similarly, the pair of brackets 58 are spaced apart slightly more than the external diameter of the prime mover 27, 28 and a groove 64 is formed in a bottom flange 66 between the brackets 58. Thus, one of the prime movers 27, 28 is received in the respective grooves 60, 64 and between the brackets 56, 58, and is locked in position by bolts 68.

FIGS. 4*c* and 4*c* show an alternative to the lock ring 38, which can be replaced with a clamp 70. The clamp 70 is made in two parts that form a hollow cylinder with a radially inwardly projecting annular shoulder 72 and radially outwardly protruding ears 74 which can be secured together by lock screws 76. The two parts of the clamp 70 are placed around the prime mover 27, 28, similarly to the lock ring 38 shown in FIG. 1, while inserting the radially inwardly projecting annular shoulder 72 of the clamp 70 into the annular groove 42 of the prime mover 28. The two halves of the clamp 70 are then secured together by lock screws 76, which are inserted through bores in the lock ears 74.

In a further embodiment of the invention, the prime mover 28 is secured to the BOP 22 by a bottom end cap 78, as shown in FIG. 4*e*. The bottom end cap 78 includes an extended side wall 80 that extends upwardly over the lower section of the prime mover 28, so that the bottom end cap 78 inhibits the prime mover 28 from upward movement relative to the BOP 22. The locking arrangement illustrated in FIGS. 4*c*, 4*d* and 4*e* may be used in conjunction with either bores 30 shown in FIG. 1 or brackets 56, 58 shown in FIGS. 4*a* and 4*b*. The locking mechanisms illustrated in FIGS. 4*a* through 4*e* may be used to secure prime movers to BOP 22 or the high pressure valve 22'.

FIG. 5 illustrates a hydraulic circuit for supplying pressurized fluid to actuate the prime movers 28. The hydraulic circuit, generally indicated by reference numeral 82, includes a motor 84 coupled to a pump 86. The pump 86 pumps hydraulic fluid from a reservoir (not shown) into an accumulator 88, which generally includes a bladder to ensure that the hydraulic pressure is maintained in the hydraulic circuit 82 in case the pump 86 or motor 84 fail. The pressurized hydraulic fluid from the accumulator 88 is distributed by two valves 90, so that the prime movers 28 can be controllably actuated to extend or retract. When hydraulic fluid is introduced into one end of the prime movers 28 the exhausted hydraulic fluid drains from the other end of the prime movers 28 into the reservoir (not shown).

FIG. 6 illustrates the apparatus 20 shown in FIG. 1 further including a threaded connector 92, commonly called a Bowen connector. The threaded connector 92 includes a base flange 94 and a cylindrical fitting 96, with a central bore 98 that extends therethrough. The central bore 98 has a diameter substantially the same size as the central bore 32 of the BOP 22. A landing bore 100 has a larger diameter than the central bore 98. External threads 102 are provided at the top of the fitting 96. The treaded connector 92 is mounted to the top 36 of the BOP 22 by a plurality bolts 104, which extend through bores in the base flange 94 and are received in the threaded bores 50 in the top 36 of the BOP 22.

Figure 7:
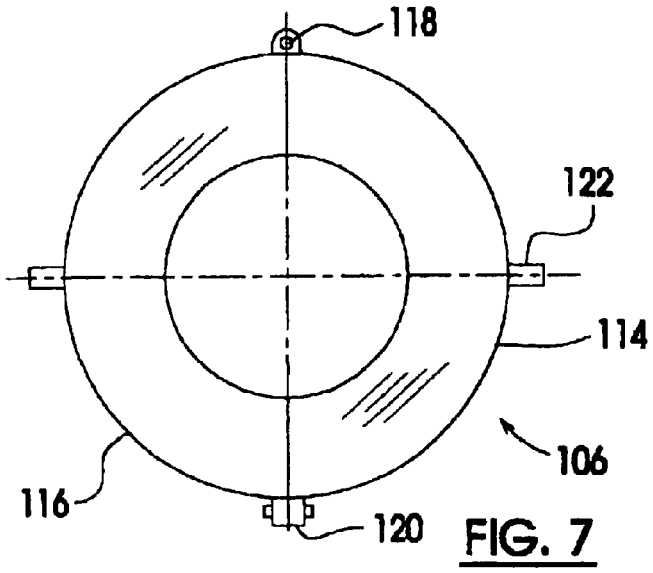
FIG. 7 is a top plan view of the protective bonnet shown in FIG. 6.

A protective bonnet 106 is selectively placed over the threaded connector 92. The bonnet 106 includes a cylindrical side wall 108 and a top wall 110 with a central bore 112 therethrough. As more clearly shown in FIG. 7, the bonnet 106 is assembled from two parts 114 and 116, which are pivotally connected together on one side by a hinge pin 118 to permit the bonnet 106 to be opened and closed. A locking device 120 is provided on the opposite sides of the two parts 114, 116 to lock the two parts 114, 116 together. A pair of lifting ears 122 with bores 125 therethrough (see FIG. 6) are provided on the respective parts 114, 116 to permit the bonnet 106 to be lifted as required.

Figure 8:
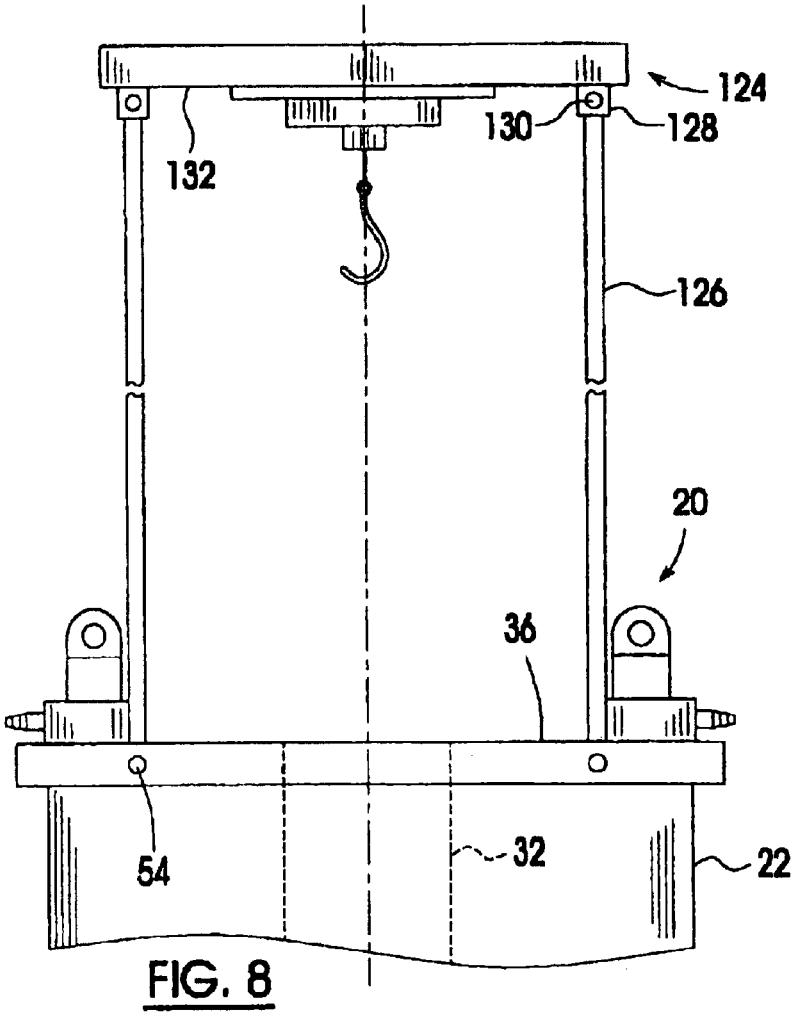
FIG. 8 is a partial side elevational view of the spool shown in FIG. 1 or the spool shown in FIG. 2, further including a hydraulic crane mounted thereon in accordance with a further embodiment of the invention.

FIG. 8 illustrates the apparatus 20 shown in FIG. 1, further including a hydraulic crane 124 which is removably mounted to the top 36 of the BOP 22. The hydraulic crane 124 is supported by four support beams 126, a top end of each being inserted into a corresponding socket 128 of the hydraulic crane 124 and locked by set screws 130. The bottom end of each support beam 126 is received in one of the bores 52 (see FIG. 2) in the top 36 of the BOP 22 and secured by the set screws 54, as described above.

FIG. 9, which appears on sheet six of the drawings, shows the hydraulic crane 124 in more detail. The hydraulic crane 124 includes a base 132 which can be a plate, a cylindrical box structure, a beam, or the like. A bracket member 134 is rotatably coupled to the base 132. The bracket member 134 includes a downwardly extending arm 136. A lower end of the arm 136 is connected to a telescoping boom 138 by a pivot pin 140. A hydraulic cylinder 142 interconnects a base section 144 of the telescoping boom 138 and the bracket member 134, so that the telescoping boom 138 can be pivoted by the hydraulic cylinder 142 about the pivot pin 140 from a substantially horizontal position to a substantially vertical position, as shown by the arrow 146. An extension 148 of the telescoping boom 138 can be extended or retracted by another hydraulic cylinder, or as shown in FIG. 9, by pressurized hydraulic fluid introduced into an inner chamber of the base section 144, which exerts hydraulic pressure on the piston 150 of the extension 148. A cable 152 is wound around a drum 154 which is rotatably mounted to the arm 136 and is driven by a hydraulic motor (not shown). The cable 152 extends along the length of the telescoping boom 138 and around a pulley 156 which is rotatably mounted to a free end of the extension section 148, and is connected at its free end to a lifting hook 158, for example. The bracket member 134 with the telescoping boom 138 is rotatable about a vertical axis relative to the base 132 in a range of about 360° when the telescoping boom 138 is in a retracted or a downwardly pivoted position. When the telescoping boom 138 is extended and horizontally oriented as shown in FIG. 9, the rotation of the bracket member 134 with the telescoping boom 138 is limited to a space between two adjacent supporting beams 126 shown in FIG. 8. A hydraulic motor 159 is preferably provided on the top of the base 132 to rotate the bracket member 134.

The prime movers 28 shown in FIG. 1 are used to support a heavy workload, such as the weight of an entire tubing string suspended in a well bore, or the high fluid pressure acting on tools to be inserted into the well bore. The hydraulic crane, however, is used for different purposes and can be used in an area surrounding the wellhead, but can only support a limited workload. For example, the hydraulic crane 124 in accordance with this embodiment has a limited lifting capacity of about three tons. During a well completion, re-completion, servicing or workover, various tools or equipment need to be hoisted to the top of the wellhead or suspended above the wellhead for assembly before the tools or equipment are connected to a tubing string and/or the prime movers 28 which then perform the lifting and inserting functions under a full workload. Conventionally, these lifting functions are performed by a service rig and/or a boom truck. With the hydraulic crane 124, the apparatus 20 is enabled to provide all of the services required for a rigless well completion, re-completion, servicing or workover. A few examples of applications using the apparatus 20 in well completion, re-completion, servicing or workover are described below.

Figure 10A:
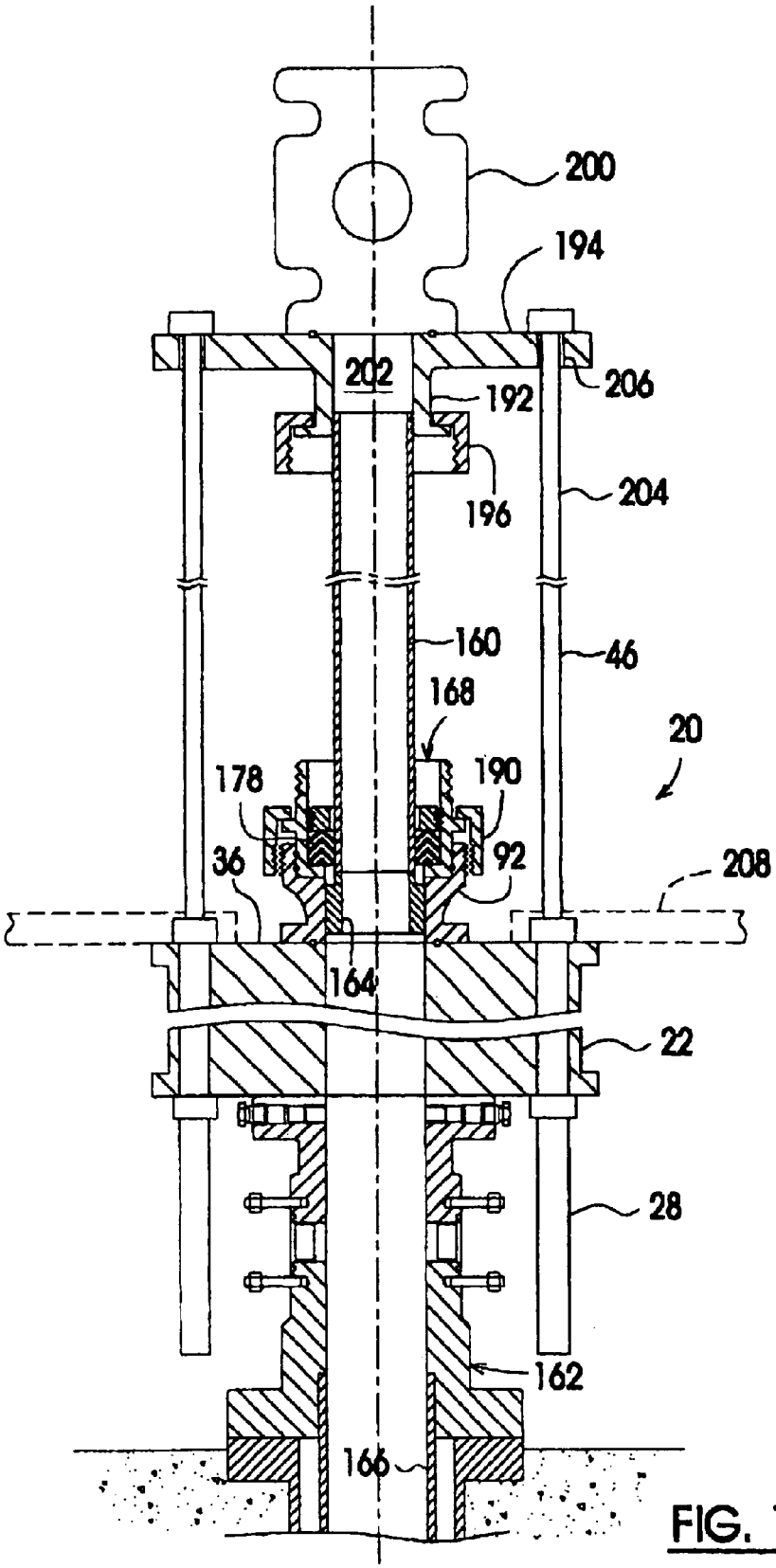
FIG. 10*a* is a cross-sectional view of a wellhead equipped with a spool in accordance with one embodiment of the invention, illustrating the insertion of a mandrel of a blowout preventer protector with a sealing assembly for pack-off in a casing of a well to be stimulated during a well workover procedure.

FIG. 10*a* illustrates an example of using the apparatus 20 to insert a mandrel 160 of a BOP protector into a wellhead 162. The mandrel 160 has a seal assembly 164 mounted to its bottom end for pack-off inside a casing 166 of the well to be stimulated. Mounted to the top of the wellhead 162 is the BOP 22 with the two prime movers 27, 28. The installation of the BOP 22 is accomplished by a boom truck (not illustrated) for example, used to hoist the BOP 22 from a transportation deck (not shown). The deck, preferably includes bores for receiving the two prime movers 27, 28 that project downwardly from the BOP 22, so that they do not have to be removed from the BOP 22 for transportation. The hydraulic crane 124, as shown in FIG. 8 is then mounted to the top of the BOP 22. In order to more clearly illustrate other parts of the apparatus 20, the hydraulic crane 124 is not shown in FIG. 10*a*. After the BOP 22 with prime movers 27, 28 and the hydraulic crane 124 are mounted to the wellhead 162, the boom truck is no longer required. If the boom truck is kept on site, the hydraulic crane 124 is not required.

Figure 10D:
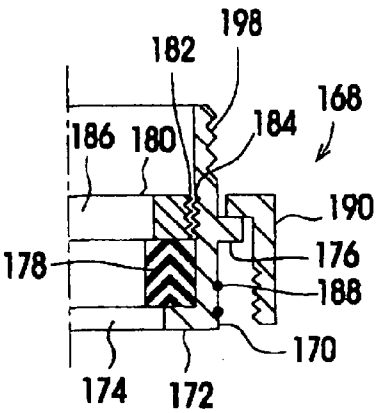
FIG. 10*d* is a partial cross-sectional view of an annular adapter for use with the Bowen union shown in FIG. 10*a*, illustrating the details thereof.

The threaded connector 92 is hoisted by the hydraulic crane 124 (see FIG. 8), for example, to the top of the BOP 22 and is secured thereto if the threaded connector 92 has not been previously connected to the BOP 22. The mandrel 160 with its sealing assembly 164 is equipped with an annular adapter 168. The annular adapter 168, more clearly shown in FIG. 10*d* includes a cylindrical side wall 170 and a bottom wall 172 with a central bore 174, which has the same diameter as the central bore 98 of the threaded connector 92 (see FIG. 6). An external shoulder 176 protrudes from the cylindrical side wall 170. Packing rings 178 constructed of brass, rubber and fabric are disposed within the cylindrical side wall 170 and are secured between the bottom wall 172 and a gland nut 180, which has external threads 182 that engage corresponding internal threads 184 in the cylindrical side wall 170. The packing rings 178 and the gland nut 180 define a vertical passage 186 of a same diameter as a periphery of the mandrel 160, to provide a fluid seal between the mandrel 160 and the annular adapter 168, as shown in FIG. 10*a*. The annular adapter 168 further includes two high-pressure O-rings 188 engaged in grooves around the periphery of the cylindrical side wall 170 below the external shoulder 176. The O-rings 188 provide a fluid tight seal between the annular adapter 168 and the threaded connector 92 when the annular adapter 168 is seated within the threaded connector 92, as shown in FIG. 10*a*. A lock nut 190 engages the external shoulder 176 and includes internal threads that are threadedly engaged with the threaded connector 92 when the annular adapter 168 is seated within the threaded connector 92.

The mandrel 160, which is surrounded by the annular adapter 168 is connected at its top end to a connector 192 that includes a base plate 194. The connection of the top end of the mandrel 160 to the connector 192 is described in detail in Applicant's issued patents. The connector 192 further includes a lock nut 196 for engagement with the external threads 198 of the annular adapter 168 (see FIG. 10*d*).

The combination of the mandrel 160 with the base plate 194 and the annular adapter 168 is hoisted by the hydraulic crane 124 (see FIG. 8) and is positioned above the top 36 of the BOP 22. The combination is lowered by the hydraulic crane 124, or a crane truck (not shown), until the seal assembly 164 of the mandrel 160 is inserted into the central bore of the threaded connector 92, or further down into the central bore of the BOP 22 above the blind rams 26 (see FIG. 1), which are closed.

During this operation, the annular adapter 168 can be suspended on the mandrel 160 by a frictional force between the packing rings 178 and the periphery of the mandrel 160, or can be suspended from the lock nut 196. When the mandrel 160 is maneuvered to this position, the annular adapter 168 is pushed down and seated within the threaded connector 92, and is locked down using the lock nut 190. FIG. 10*a* specifically illustrates this stage.

A pair of extension rods 204, which are inserted through bores 206 of the base plate 194, are connected to the extended piston rams 46 of the prime movers 28. A high pressure valve 200 is then connected to a top of the base plate 194, in order to controllably close the fluid passage defined by the central bore 202 of the base plate 194. Thus, the mandrel 160 is ready to be inserted into the wellhead 162 against well fluid pressure. The blind rams 26 of the BOP 22 (see FIG. 1) are opened and the mandrel 160 is subjected to the well fluid pressure. The pressure is preferably balanced between the mandrel 160 and the well bore before the blind rams are opened, using methods well known in the art. An upward force exerted by the well fluid pressure on the mandrel 160, is transferred by means of the base plate 194 and the extension rods 104, to the piston rams 46 of the prime movers 27 28, which are hydraulically locked. The prime movers 27, 28 are then actuated to lower the base plate 194 and thereby insert the mandrel 160 through the packing rings 178 of the annular adapter 168 and into the wellhead 162 until the seal assembly 164 of the mandrel 160 is packed off within the casing 166. The lock nut 196 of the connector 192 is then threadedly engaged with the annular adapter 168.

The well is now ready for a well stimulation procedure, which is well known in the art and will not be further described.

Figure 10C:
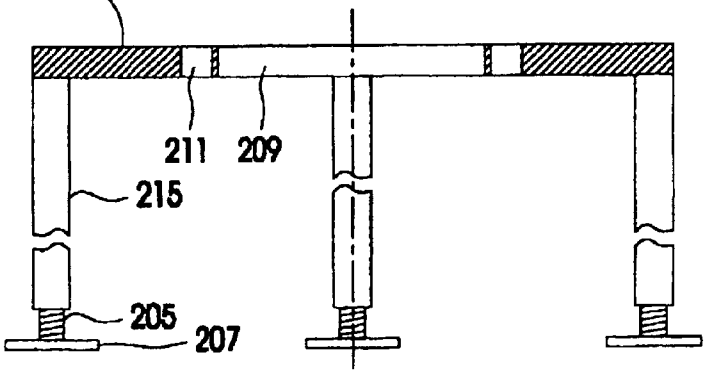
FIG. 10*c* is a cross-sectional view of the work platform shown in FIG. 10*b;*
Figure 10B:
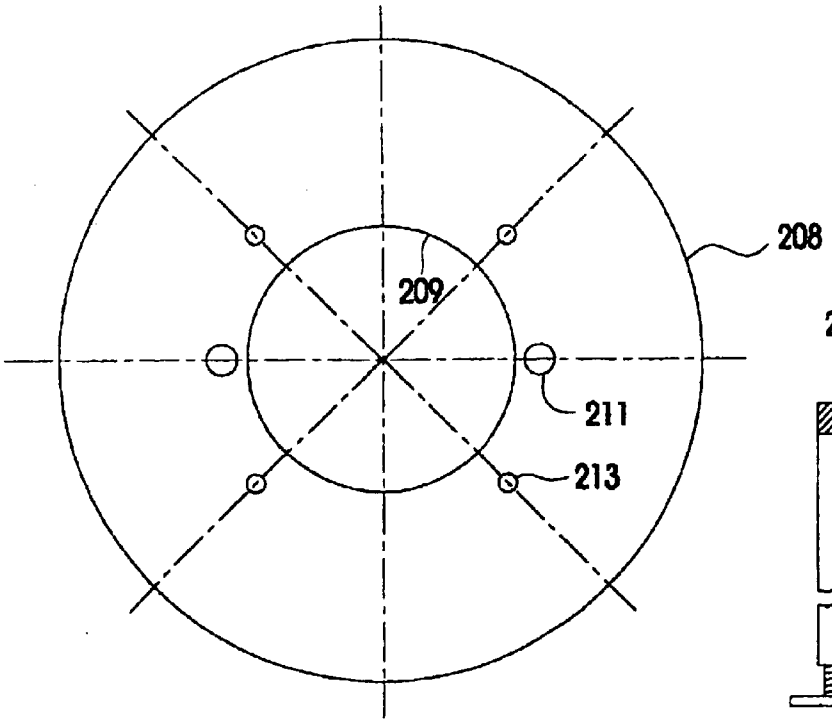
FIG. 10*b* is a top plan view of a work platform used with the spool shown in FIG. 10*a;*

A work platform 208 (more clearly shown in FIGS. 10*b* and 10*c*) is optionally provided so that operators have a place to stand for working over the wellhead 162. The work platform 208 has a central aperture 209 and a plurality of openings 211 and 213. The work platform 208 is substantially horizontally disposed at a level not lower than the top 36 of the BOP 22 (see FIG. 10*a*), and is preferably placed on the top 36 of the BOP 22, while being supported by legs 215 which rest on the ground. The legs 215 include height adjustment mechanisms that include pressure feet 207 rotatably connected to threaded extension legs 205. When the work platform 208 is set as shown in FIG. 10*a*, the central opening 209 receives the threaded connector 92 and the openings 211, 213 permit the respective piston rams 46 of the prime movers 27, 28 and the supporting beams 126 of the hydraulic crane 124 (see FIG. 8) to pass therethrough.

Figure 11:
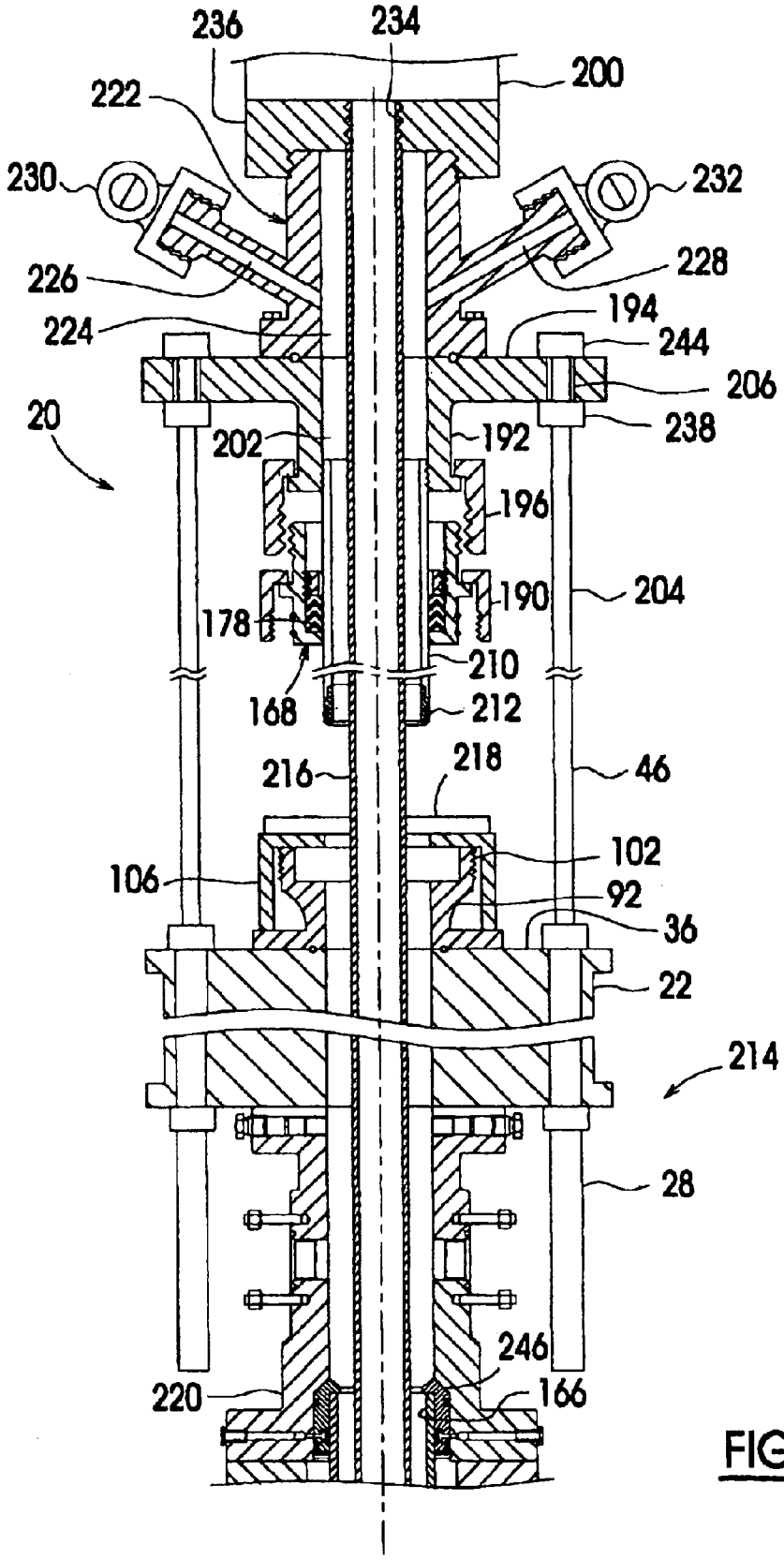
FIG. 11 is a cross-sectional view of a wellhead equipped with an embodiment of the invention, for inserting a mandrel of a blowout preventer protector having an annular sealing body for sealing engagement with a bit guide that protects a top of a casing of the well, while supporting a tubing string in the well bore.

Another example of using the apparatus 20 in a rigless well completion, re-completion, servicing or workover is illustrated in FIG. 11. A mandrel 210 of a BOP protector having a pack-off assembly 212 at a bottom end thereof, is to be inserted through a wellhead 214 from which a tubing string is suspended. The tubing string is supported by, for example, slips 218 or some other support mechanism, at the top of the wellhead 214. The BOP 22 of the present invention is mounted to a tubing head spool 220. The tubing string 216 is normally supported by a tubing hanger inside the tubing head spool 220, but the tubing hanger has been pulled out of the well using the prime movers 27, 28, for example, to an extent that a length of the tubing string 216 that extends above the wellhead 214 is greater than a length of the BOP 22. The tubing string 216 is then supported on the top of the protective bonnet 106 using slips 218, for example, before the mandrel insertion procedure begins. The process of using prime movers 27, 28 to install a tubing hanger (not shown) in the tubing head spool 220 or to remove the tubing hanger from same will be further described with reference to FIG. 12.

A fracturing head 222 having a central passage 224 and at least two radial passages 226, 228 is mounted to the top of the base plate 194, before the combination of the mandrel 210, the base plate 194 and the annular adapter 168 is hoisted above the wellhead 214. Two high pressure valves 230, 232 are also mounted to the fracturing head 222 to close the radial passages 226, 228, respectively. The mandrel 210 is aligned with the tubing string 216 and is lowered over the tubing string 216 until the top end 234 of the tubing string 216 extends above the top end of the fracturing head 222. A tubing adapter 236 is then connected to the top end 234 of the tubing string 216. The tubing adapter 236 is also connected to the top of the fracturing head 222. The extension rods 204 are then connected to the piston ram 46 of the prime movers 27, 28 which are in the extended position, and to the base plate 194.

After the base plate 194 is connected to the prime movers 27, 28, the hydraulic crane 124 (see FIG. 8) can be used to hoist a high pressure valve 200 (partially shown) to the top of the tubing adapter 236. The high pressure valve 200 is then mounted to the top of the tubing adapter 236.

The tubing string 216 and the mandrel 210 are supported by the prime movers 27, 28 so that the slips 218 and the cylindrical protector 106 can be removed in order to clear the passage for insertion of the mandrel 210. The prime movers 27, 28 are actuated to lower the tubing string 216 and the mandrel 210 onto the top of the BOP 22 so that the annular adapter 168 can be pushed down over the mandrel 210 and connected to the threaded connector 92, similarly to the position illustrated in FIG. 10*a*. The mandrel 210 is inserted into the threaded connector 92 and the BOP 22, but remains above the BOP tubing rams 24 (FIG. 1). Persons skilled in the art will understand that in a high pressure well bore, the tubing string 216 is plugged and the tubing rams 24 of the BOP are closed around the tubing string 216 before the installation procedure begins. Thus, the fluids under pressure inside the well bore are not permitted to escape from the tubing string 216, or from the annulus between the tubing string 216 and the wellhead 214.

In order to open the tubing rams 24 of the BOP 22 and further insert the mandrel 210 down through the wellhead 214, the high pressure valves 230, 232 and 200 must be closed and the annular adapter 168 must be sealingly connected to the threaded connector 92. The packing rings 178 and all other seals between interfaces of the connected parts seal the central passage of the mandrel 210 against pressure leaks. The tubing rams 24 of the BOP 22 are opened after pressure is balanced across the BOP tubing rams 24. This procedure is well known in the art. After the BOP tubing rams 24 are opened, the prime movers 27, 28 are operated to lower the mandrel 210 down through the BOP 22. When the mandrel 210 is in an operating position, the bottom end of the pack-off assembly 212 is in sealing contact with a bit guide 246 connected to a top of the casing 166. The bit guide 246 caps the casing 166 to protect the top end of the casing 166 and provides a seal between the casing 166 and the tubing head spool 220, in a manner well known in the art. The mandrel 210 has optional and variable lengths of extension sections. Thus, the assembled mandrel 210 including the pack-off assembly 212, is pre-adjusted in length to ensure that the lock nut 196 is able to be threadedly engaged with the annular adapter 168 when the pack-off assembly 212 is seated against the bit guide 246. The prime movers 27, 28 are preferably hydraulically locked during the well stimulation procedure that follows, in order to support the weight of the tubing string 216, including the equipment and tools attached thereto.

Figure 12:
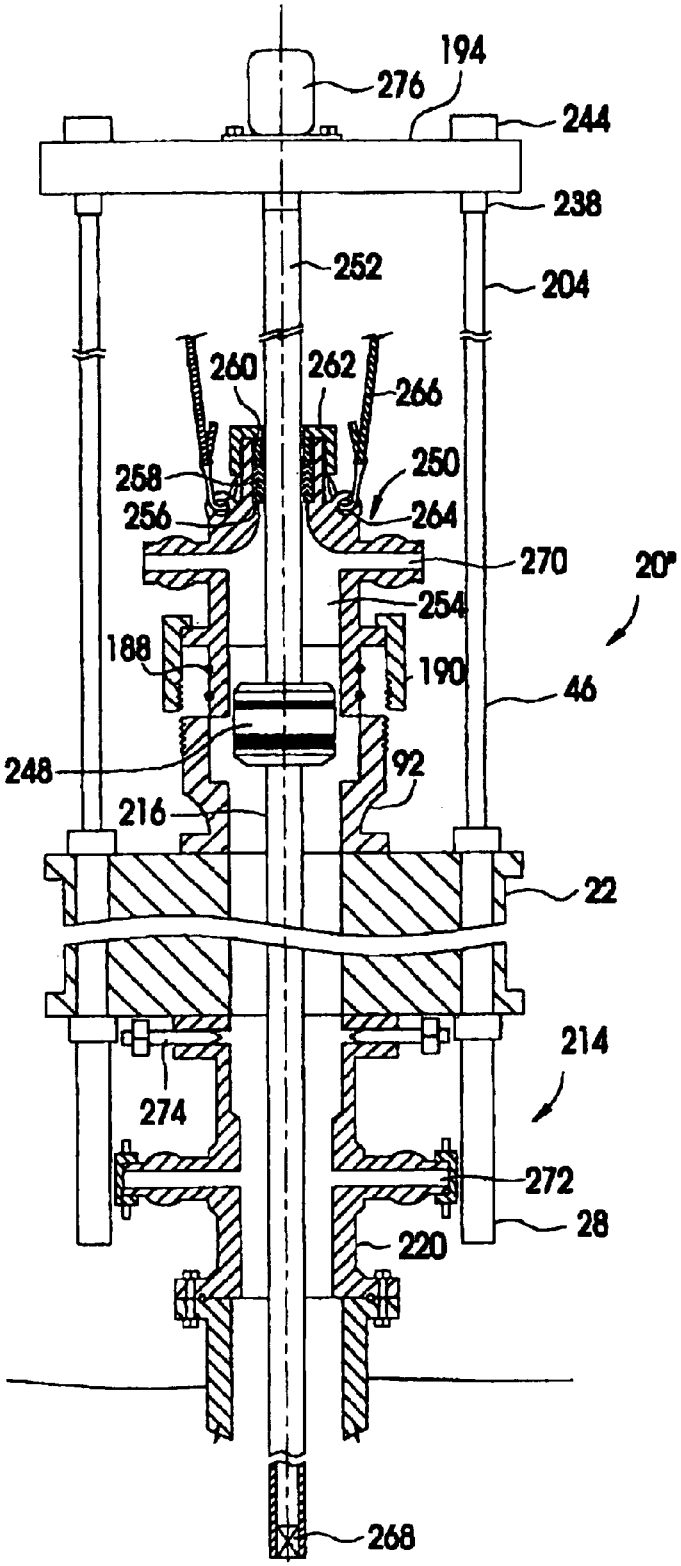
FIG. 12 is a cross-sectional view of a wellhead equipped with an embodiment of the invention, for inserting a tubing hanger with the tubing string into a tubing head spool in a live well.

FIG. 12 illustrates a procedure for using an apparatus 20", in accordance with a further embodiment of the invention, to install a tubing hanger 248 into the tubing head spool 220 or remove it from the tubing head spool 202. It is well know in the art that the tubing hanger 248 must be set in the tubing head spool 220 in order to suspend the production tubing string 216 in the well after the production tubing string 216 has been run into the well. The tubing hanger 248 is connected to a top end of the tubing string 216, and conventionally, special equipment is required to run the tubing hanger 248 into the tubing spool 220. It is also well known that the tubing hanger 248 must be removed from the tubing head spool when a mandrel 210 of a BOP protector is to be inserted into the wellhead 214, as illustrated in FIG. 11.

The apparatus 20" permits the tubing hanger 248 to be rapidly and safely inserted into or removed from the tubing head spool 220 of a "live" well without use of an additional BOP. The apparatus 20" is similar to the apparatus 20 and 20' illustrated in FIGS. 10*a* and 11, and similar parts are indicated by the same reference numerals and are not described. However, an annular adapter 250, described in Applicant's copending U.S. patent application Ser. No. 09/791,980 filed Feb. 23, 2001, the specification of which is incorporated herein by reference, replaces the annular adapter 168 of the apparatus 20 described above. A landing joint 252 which is rotatably suspended from and supported by a base plate 194 and is adapted to be connected to the tubing hanger 248, replaces the connector 192 of the apparatus 20, which connects the annular adapter 168 to the base plate 194 as illustrated in FIG. 10*a*. The landing joint 252 is inserted through a passage 254 of the annular adapter 250. The passage 254 includes a packing cavity at a top thereof, which retains a steel packing washer 256. A high pressure packing 258, such as a chevron packing, is retained above the steel packing washer 256. The high pressure packing 258 closely surrounds and provides a high pressure seal around the landing joint 252 to ensure that well fluids do not escape to the atmosphere when the tubing hanger 248 is inserted into, or removed from, the tubing head spool 220. The high pressure packing 258 is retained by a gland nut 260. A safety nut 262 threadedly engages a spiral thread on an outer periphery of the top end of the annular adapter 250. A top wall of the safety nut 262 projects inwardly to cover the gland nut 262 in order to ensure that the gland nut 262 is not stripped by fluid pressures exerted on the high pressure packing 258.

A side wall of the annular adapter 250 includes at least two eyes or hooks 264 which receive chain or cable 266 that is connected to the hydraulic crane 124 (see FIG. 8) in order to suspend the annular adapter 250, while the landing joint 252 is connected to a top end of the tubing hanger 248. The annular adapter 250 is also suspended while slips 218 (see FIG. 11) that suspend the production tubing string 216 are removed to permit the tubing hanger 248 to be inserted down through the BOP 22.

After the landing joint 252 is connected to a top end of the tubing hanger 248, the extension rods 204 are connected to the piston rams 46 of the prime movers 28, which are in their extended condition and are hydraulically locked. The slips 218 (see FIG. 11) are then removed and the weight of the production tubing string 216 is therefore transferred to the prime movers 28. Thereafter, the landing joint 252 is lowered to move the tubing hanger 248 down into the threaded connector 92 and the BOP 22, but support it above the closed tubing rams 24 of the BOP 22. A retrievable plug 268 which seals a bottom of the production tubing string 216, seals the well fluids within the well. After the slips 218 and the protective bonnet 106 (see FIG. 11) are removed and the tubing hanger 248 is lowered by the prime movers 28, the annular adapter 250, which is suspended from the cables 266 by the hydraulic crane 124 (see FIG. 8), is lowered so that the lock nut 190 of the annular adapter 250 can be threadedly engaged with the threaded connector 92. The O-rings 188 around the annular adapter 250 seal the interface between the annular adapter 250 and the threaded connector 92.

After the annular adapter 250 is mounted to the BOP 22, pressure is equalized between an annulus of the live well and the annular adapter 250 using a bleed hose (not shown) connected between the pressure bleed ports 270 on the annular adapter 250 and corresponding ports or valves 272 of the tubing head spool 220. After the respective valves are closed and the bleed hose is removed, the tubing rams 24 (FIG. 1) of the BOP 22 are opened in order to permit the tubing hanger 248 to be lowered into the tubing head spool 220 by operating the prime movers 28. Once the tubing hanger 248 is seated in the tubing head spool 220, lock bolts 274 in the tubing head spool 220 are adjusted to lock the tubing hanger 248 in the tubing head spool 220.

The landing joint 252 is then rotated, preferably by a hydraulic motor 276, to disconnect the landing joint 252 from the tubing hanger 248, and the landing joint 252 is raised with the base plate 194 by operating the prime movers 28 until the landing joint 252 is above the blind rams 26 (FIG. 1) of the BOP 22. After the blind rams 26 of the BOP 22 are closed, pressure is vented from the annular adapter 250 by, for example, opening the pressure bleed ports 270. Subsequently, the annular adapter 250 is removed by the hydraulic crane 124 (see FIG. 8).

The steps required to remove the tubing hanger 248 from the tubing head spool 220 are a reverse of the above-described process.

Figure 13:
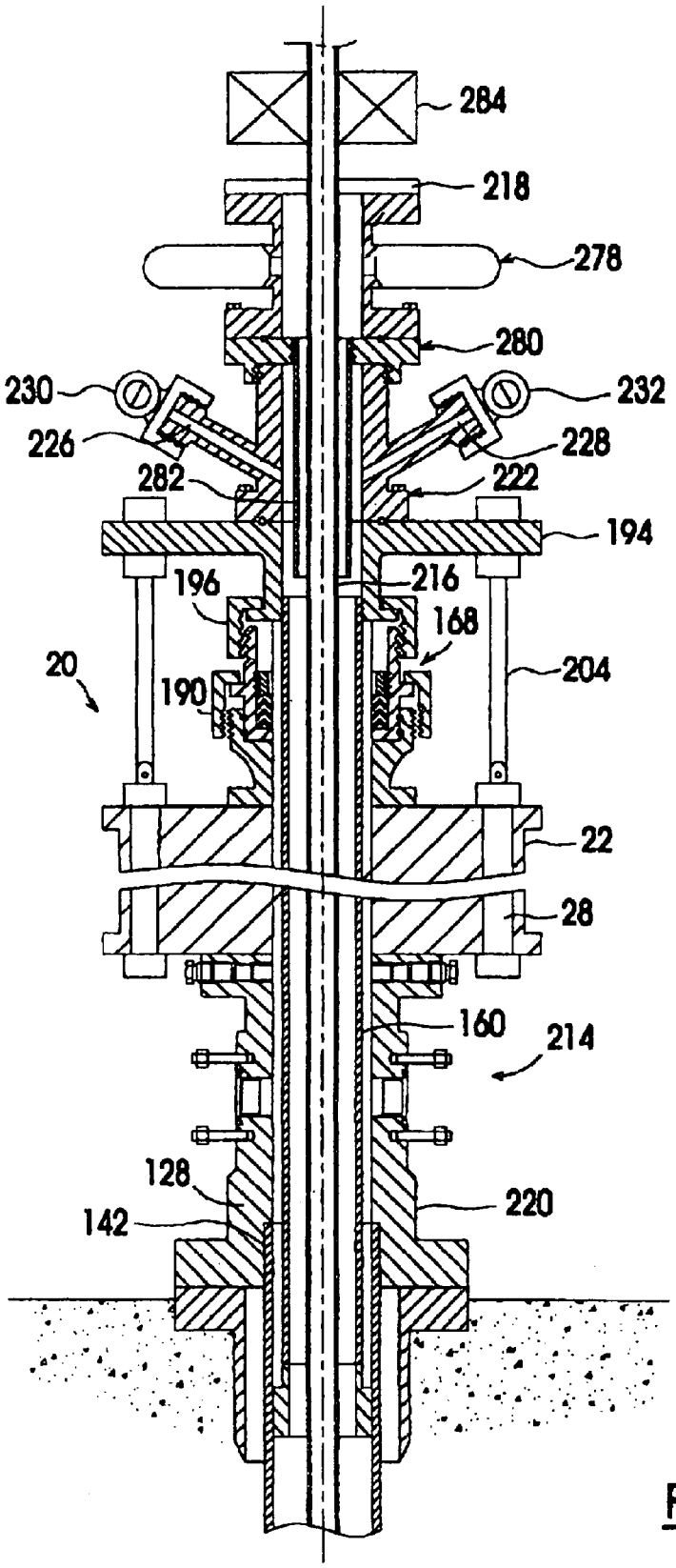
FIG. 13 is a cross-sectional view of a wellhead equipped with an embodiment of the invention for running a coil tubing string into and out of the well after a blowout preventer protector is inserted through the wellhead.

As a further example of using the apparatus 20 for rigless well completion, re-completion, servicing or workover, FIG. 13 illustrates a method of installing the mandrel 160 of a BOP protector to permit the tubing string 216 to be run into or out of the well while protecting the BOP 22 on the wellhead during a well stimulation treatment. In much the same way as described above with reference to FIG. 10*a*, the mandrel 160 with the annular adapter 168 and the fracturing head 222 are assembled to the base plate 194, and a second BOP 278 is mounted to a top of a tubing adapter 280. A blast joint 282 is threadedly engaged with the tubing adapter 280 so that the blast joint 282 is suspended from the tubing adapter 280. The blast joint 282 has an inner diameter large enough to permit the coil tubing string 216 to be run in and out therethrough. The blast joint 282 protects the coil tubing string 216 from erosion when abrasive fluids are pumped through the radial passage 226, 228 in the fracturing head 222, after the coil tubing string 216 is run into the well and a well stimulation treatment is begun.

When the combination of the mandrel 160, the annular adapter 168, the base plate 194, the fracturing head 222, which also includes the high pressure valves 230, 232, and the second BOP 278 is assembled, the combination is hoisted by the hydraulic crane (see FIG. 8), to a position over the wellhead 214. As will be well understood, the second BOP 278 may be mounted to the fracturing head 222 after it is connected to the extension rods 204. The procedure then follows the steps described with reference to FIG. 10*a* until the mandrel 160 is inserted into the wellhead 214 in the operative position as shown in FIG. 13, and is locked into position by the lock nuts 190, 196.

As further illustrated in FIG. 13, a coil tubing injector 284 is hoisted by a boom truck (not shown) or the hydraulic crane 124 (see FIG. 8) above the second BOP 278, and is mounted to a top of the BOP 278. The coil tubing string 216 can then be run into, and out of, the well without removing the apparatus 20 from the wellhead 214. The tubing string 126 can also be moved up or down in the well while stimulation fluids are being pumped into the well.

Figure 14A:
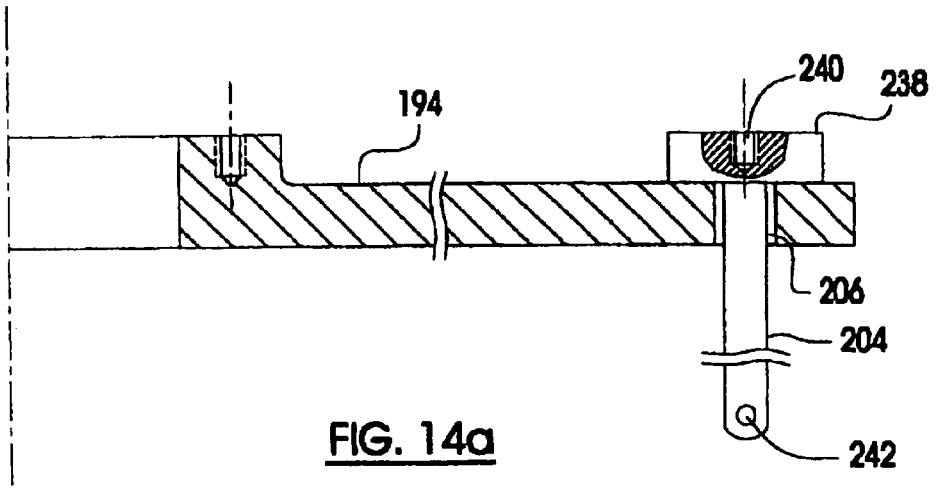
FIGS. 14*a* and 14*b* are partial cross-sectional views of configurations in accordance with the invention for connecting a prime mover to a base plate used to set tools on a live well.
Figure 14B:
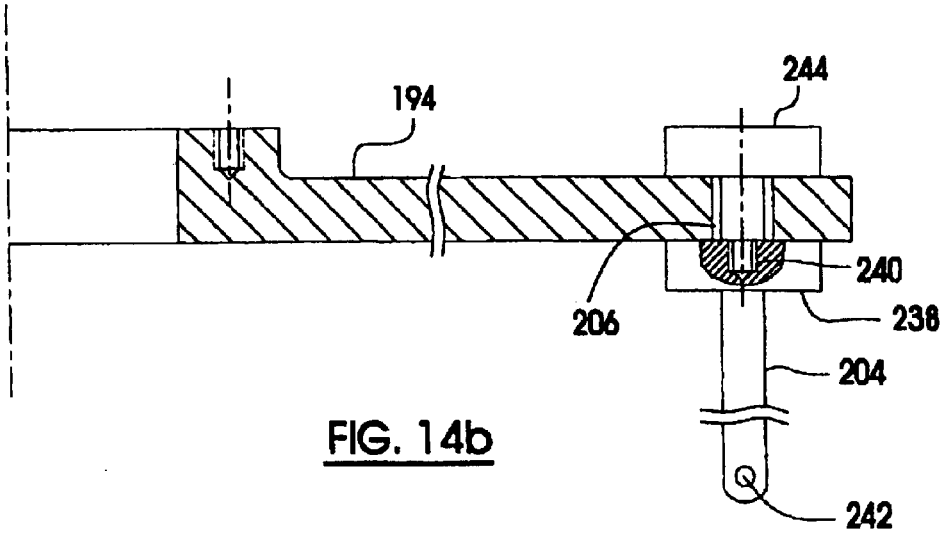

The connection of the extension rods 204 to the base plate 194 is more clearly illustrated in FIGS. 14*a* and 14*b*. The extension rod 204 includes a hex head 238, which may include a threaded bore 240 in a top thereof. A connector 242 is provided at a lower end of the extension rod 204 for connection to the piston ram 46 (see FIG. 1) of a prime mover 27, 28, or to another extension rod. When the apparatus 20 is used to install tools in the wellhead under well fluid pressure, which acts on the tools and offsets a weight of the tools, as illustrated in FIG. 10*a*, the extension rod 204 is inserted through the bore 206 from a top of the base plate 194, as shown in FIG. 14, to resist an upward force during insertion of the tools. If a tubing string is supported, as shown in FIG. 11, the workload is generally a downward force due to the weight of the combination of the tools and the tubing string, regardless of well fluid pressure. In such cases, the extension rod 204 is connected to the base plate 194 by an extension rod connector 244, as shown in FIG. 14*b* and FIG. 11, so that the prime movers 28 can resist both upward and downward forces.

The apparatus of the present invention can be used in various other operations required for well completion, re-completion, servicing or workover without requiring a service rig. Under normal conditions, the service rig can be released as soon as drilling is complete, which represents a considerable savings for well owners and operators.

Although the embodiments of the invention described above show two prime movers 27, 28, it should be understood by those skilled in the art that three or more can be used. Other modifications and improvements to the above-described embodiments of the present invention may become apparent to those skilled in the art. The foregoing description is intended to be exemplary rather than limiting.

The scope of the invention is therefore intended to be limited solely by the scope of the appended claims.

I claim:

1. An apparatus for well completion, re-completion, servicing or workover, comprising:

a spool for pressure containment adapted to be secured to a top of a wellhead of the well, the spool having a central bore in fluid communication with a well bore and a flow control mechanism to permit selective containment of pressurized fluid within the well; and at least two substantially vertically oriented bi-directional prime movers secured to opposite sides of the spool, so that a workload acting on the prime movers is transferred to the spool, each of the prime movers having lower ends, wherein the prime movers are secured to the spool so that the lower ends of the respective prime movers project downwardly from a bottom of the spool.

2. An apparatus as claimed in claim 1 wherein the spool comprises a blowout preventer.

3. An apparatus as claimed in claim 2 wherein the blowout preventer comprises a Bowen connector at a top thereof for connecting other components to be mounted thereon, the Bowen connector having a central bore that communicates with a central bore of the blowout preventer.

4. An apparatus as claimed in claim 3 wherein the Bowen connector is removable from the blowout preventer.

5. An apparatus as claimed in claim 3 further comprising a protective bonnet for protecting the Bowen connector and for providing a support surface for supporting a tubing string suspended in the well when the bonnet is removably placed over the Bowen connector.

6. An apparatus as claimed in claim 5 wherein the protective bonnet comprises a cylindrical body including first and second parts, with a cylindrical side wall and a top wall with a central bore therethrough, the first and second parts being pivotally connected along one side edge to permit the protective bonnet to pivotally opened and close.

7. An apparatus as claimed in claim 3 further comprising an annular adapter including packing means, the annular adapter being selectively secured to the Bowen connector to provide a seal between a tubular and the Bowen connector when the tubular extends through the central bore of the Bowen connector and into the spool.

8. An apparatus as claimed in claim 2 further comprising a work platform having a central aperture, and a plurality of openings, the work platform being adapted to be substantially horizontally disposed on a top of the blowout preventer.

9. An apparatus as claimed in claim 8 wherein the platform is placed on the top of the blowout preventer, the Bowen connector being received in the central aperture, and the openings permitting the prime movers to pass therethrough.

10. An apparatus as claimed in claim 1 wherein the spool comprises a high-pressure valve.

11. An apparatus as claimed in claim 1 wherein the prime movers comprise hydraulic cylinders.

12. An apparatus as claimed in claim 1 wherein the prime movers comprise screw jacks.

13. An apparatus as claimed in claim 1 wherein the prime movers comprise ball jacks.

14. An apparatus as claimed in claim 1 wherein each of the prime movers comprises at least one stop member for transferring the workload to the spool and restraining a vertical movement of the prime mover relative to the spool when the prime mover is under the workload.

15. An apparatus as claimed in claim 14 wherein the prime movers are secured to the spool by respective bores oriented substantially parallel with respect to the central bore thereof, the prime movers being received in the respective bores and extending therethrough.

16. An apparatus as claimed in claim 14 wherein the spool comprises a pair of grooves for receiving the respective prime movers and locking devices for securing the respective prime movers in the grooves.

17. A method for well completion, re-completion, servicing or workover of a live well, comprising steps of:

mounting a spool for pressure containment to a top of a wellhead of the live well, the spool including:

a central bore in fluid communication with the well bore and a flow control mechanism for selective containment of pressurized fluid within the well bore, a pair of substantially vertically oriented bi-directional prime movers secured to the spool so that a workload can be transferred to the spool, and a Bowen connector affixed to a top of the spool;

connecting a pressure containment adapter to the Bowen connector to contain fluid pressure in the live well;

operating the prime movers to insert into the live well any one of a tubular, a downhole tool and a wellhead component; and operating the flow control mechanism, as required, to contain fluid pressure as the tubular, tool or wellhead component is inserted into the live well.

18. A method as claimed in claim 17 wherein the steps of connecting and operating further comprise steps of:

hoisting a blowout preventer protector having a mandrel and an annular adapter into position over the pressure containment spool;

connecting a base plate mounted to the blowout preventer protector to the prime movers;

operating the prime movers to lower the mandrel to permit the annular adapter to be connected to the Bowen connector;

connecting the annular adapter to the Bowen connector;

balancing pressure between the live well and the mandrel; and operating the flow control mechanism to open the well bore so that the mandrel can be injected through the wellhead into a casing of the live well.

19. A method as claimed in claim 17 wherein the steps of connecting and operating further comprise steps of:

hoisting a landing joint and an annular adapter into position over the pressure containment spool;

connecting the landing joint to a tubing hanger connected to a tubing string supported in the live well;

lifting the landing joint to remove slips supporting the tubing string;

lowering the tubing string and connecting the annular adapter to the Bowen connector;

balancing pressure between the live well and the annular adapter; and operating the flow control mechanism to open the well bore so that the tubing hanger can be injected through the wellhead into a tubing head of the live well.

20. A method as claimed in claim 17 wherein the steps of connecting and operating further comprise steps of:

hoisting a fracturing head that supports a mandrel and an annular adapter into position over the pressure containment spool;

lowering the mandrel and the fracturing head over a tubing string supported in the live well so that a top end of the tubing string extends above a top of the fracturing head;

connecting a tubing adapter to the tubing string, and connecting the tubing adapter to the fracturing head;

lifting the fracturing head to remove slips supporting the tubing string; lowering the fracturing head and connecting the annular adapter to the Bowen connector;

balancing pressure between the live well and the annular adapter; and operating the flow control mechanism to open the well bore so that the mandrel can be injected through the wellhead into sealing engagement with a casing of the well.

21. A method as claimed in claim 17 wherein the steps of connecting and operating further comprise steps of:

hoisting a fracturing head that supports a mandrel and an annular adapter into position over the pressure containment spool;

connecting to the prime movers a base plate mounted to the fracturing head;

operating the prime movers to lower the fracturing head and the mandrel to permit the annular adapter to be connected to the Bowen connector;

hoisting a second blowout preventer over the wellhead and mounting the second blowout preventer to a top of the fracturing head;

hoisting a coil tubing injector to a top of the second blowout preventer and mounting the coil tubing injector to the top of the second blowout preventer; and running coil tubing through the coil tubing injector, the second blowout preventer, the injection head and the mandrel into the live well.

* * * * *